US006205746B1

(12) United States Patent
Moss et al.

(10) Patent No.: US 6,205,746 B1
(45) **Date of Patent: *Mar. 27, 2001**

(54) POST-PROCESSING FITMENT APPLICATOR

(75) Inventors: Sheila Moss, Barrington, IL (US); Arid Larsen; Martin Krewer, both of Uddevalla (SE)

(73) Assignee: Tetra Laval Holdings & Finance, SA, Pully (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/238,768

(22) Filed: Jan. 28, 1999

(51) Int. Cl.[7] ..... B65B 61/18

(52) U.S. Cl. ..... 53/412; 53/133.2; 493/57; 493/213; 493/929

(58) Field of Search ..... 53/410, 412, 133.1, 53/133.2, 133.3, 133.4; 493/87, 929, 213, 214

(56) References Cited

U.S. PATENT DOCUMENTS

| | | | | |
|---|---|---|---|---|
| 4,507,168 | * | 3/1985 | Konaka | 493/133 X |
| 4,788,811 | * | 12/1988 | Kawajri et al. | 493/87 X |
| 4,909,434 | * | 3/1990 | Jones et al. | 493/87 X |
| 4,964,562 | * | 10/1990 | Gordon | 493/87 X |
| 4,990,200 | * | 2/1991 | Heinz | 53/133.2 X |
| 5,219,320 | * | 6/1993 | Abrams et al. | 493/87 X |
| 5,297,375 | * | 3/1994 | Reil et al. | 53/133.2 X |
| 5,304,265 | * | 4/1994 | Keeler | 156/73.1 X |
| 5,429,699 | * | 7/1995 | Abrams et al. | 493/87 X |
| 5,447,007 | * | 9/1995 | Reil et al. | 53/133.2 |
| 5,473,857 | * | 12/1995 | Keeler | 53/410 |
| 5,484,374 | * | 1/1996 | Bachner et al. | 493/87 |
| 5,716,471 | * | 2/1998 | Pape | 53/410 X |

FOREIGN PATENT DOCUMENTS

| | | | |
|---|---|---|---|
| WO 97/04953 | * | 2/1997 | (WO) . |
| WO97/04953 | * | 2/1997 | (WO) . |

* cited by examiner

*Primary Examiner*—John Sipos
(74) *Attorney, Agent, or Firm*—Welsh & Katz

(57) ABSTRACT

A post processing fitment applicator for applying a fitment to a formed, filled and sealed carton is disclosed herein. The post processing fitment applicator may be utilized in conjunction with a linear form, fill and seal packaging machine such as a TETRA REX® packaging machine. The post processing fitment applicator includes a supply of fitments, a plurality of fitment carriers, a conveyor system and a hot melt dispenser. The plurality of fitment carriers are disposed on a continuous track that partially parallels the movement of a series of formed, filled and sealed cartons on the conveyor system. The plurality of fitment carriers is capable of applying a fitment to a formed, filled and sealed carton as it is moving along the conveyor system. Each of the plurality of fitment carriers may include a fitment holder and a fitment displacement mechanism.

16 Claims, 7 Drawing Sheets

POST-PROCESSING FITMENT APPLICATOR

BACKGROUND OF THE INVENTION

1. Field of the Invention

The present invention relates to a fitment or closure applicator. More specifically, the present invention relates to a post processing fitment applicator for formed, filled and sealed gable top cartons.

2. Description of the Related Art

Gable top cartons have long been the preferred package for milk and milk related products. Recently, gable top cartons have assumed a new role as the preferred package for juices, particularly orange juice. The consumers preference for gable top cartons is at least partially generated by the perception of freshness associated with the gable top carton. The opposing top panels meeting to form the gable top with a top fin creates an image of a fresh, healthy product contained within the carton. The only detraction from this image was the lack of a tight reseal of the carton after the initial opening of the carton by a consumer. The integrated closure formed from the side of the top of the carton allowed for good pourability, however, the resealing was adequate at best.

This minor detraction was alleviated with the introduction of plastic fitments applied to the gable top cartons. The fitments, which generally include a spout with a flange and a cap, allowed for a tight reseal of the carton after the initial opening. The use of fitments on cartons further enhanced the consumer's perception that gable top cartons contained fresh and healthy products.

In the rush to meet the consumer's demand, the packaging industry developed new packaging/filling machines that applied a fitment to cartons prior to sterilization or filling. The demand to have packaging machines with the smallest "footprint" (the area of the machine) in a dairy meant that most older machines did not have sufficient space within the machine to incorporate a fitment applicator. This rendered older machines without the ability to provide a carton with a fitment thereby reducing their value to the dairy or like facility. Thus a need to apply a fitment on a formed, filled and sealed carton grew throughout the packaging industry.

Another problem necessitating the need to apply a fitment on a formed, filled and sealed carton pertains to maintaining a sterile environment within a form, fill and seal packaging machine to produce an extended shelf life ("ESL") product, a high acid ambient distribution ("HAAD") product, or an aseptic product. The ESL product allows for a product to have double or triple the refrigerated shelf life of a non-ESL product. The HAAD product allows for a high acid (pH<4.5) product such as orange juice to be stored unrefrigerated for an extended time period. The aseptic product allows for any product to be stored unrefrigerated for an extended time period. All of these products need to be produced in a sterile, contaminant-free environment.

Current in-line fitment applicators generate substantial amounts of possible contaminants such as dust, paper particles and fitment particles. Ultrasonic fitment applicators generate the greatest amount of contaminants due to the enormous sealing pressures utilized during application of the fitment to the carton. Other applicators such as hot melt fitment applicators may introduce undesirable chemicals, and also may provide inadequate seals. Although the use of induction heat sealing avoids some of the potential problems of in-line applicators, such induction heat sealing applicators necessitate the use of a carton with an aluminum barrier layer which increases the cost of the package. Further, the deliver of fitments from a supply of fitments introduces contaminants into the packaging machine environment.

Some post processing fitment applicators are currently available from the packaging industry. However, these applicators are little more than stand-alone reproductions of current in-line fitment applicators. Such applicators are not the denouement of post processing fitment applicators from the packaging industry.

BRIEF SUMMARY OF THE INVENTION

It is a primary object of the present invention to provide a post processing fitment applicator to apply a fitment to a formed, filled and sealed carton.

It is an additional object of the present invention to provide a post processing fitment applicator that is capable of properly orienting a fitment for placement on a carton.

It is an additional object of the present invention to provide a post processing fitment applicator that is capable of applying a fitment to a moving formed, filled and sealed carton.

One aspect of the present invention is a post processing fitment applicator for applying fitments to each of a series of formed, filled and sealed cartons. The applicator includes a conveyor, a continuous track, a plurality of fitment carriers, a chute and a hot melt dispenser. The conveyor transports the series of formed, filled and sealed cartons through the applicator. The continuous track is partially positioned in proximity to the conveyor. Each of the plurality of fitment carriers is moveable about the continuous track for placing a fitment on a formed, filled and sealed carton. The chute delivers fitments from a supply of fitments to each of the plurality of fitment carriers at a receiving point along the continuous track. The hot melt dispenser is disposed subsequent to the receiving point along the continuous track and coats each of the fitments on each of the plurality of fitment carriers with hot melt.

Each of the plurality of fitment carriers of the post processing fitment applicator may include a fitment holder for holding a fitment and a fitment displacement mechanism for placing the fitment on a formed, filled and sealed carton. The supply of fitments of the post processing fitment applicator may include a hopper connected to the chute, a holding bin, and an elevator disposed to transport fitments from the bin to the hopper. The conveyor system may transport a set number of cartons at predetermined intervals for application of fitments to the cartons. The post processing fitment applicator may also include a housing encompassing at least the continuous track and the hot melt dispenser. Each of the plurality of fitment carriers of the post processing fitment applicator may be moveable toward and away from the cartons being conveyed on the conveyor system. The fitment displacement mechanisms of the post processing fitment applicator may include an U-shaped frame with a projection thereon for engagement with a fitment.

Another aspect of the present invention is a method for applying a fitment to a formed, filled and sealed carton. The first step of the method includes placing a fitment in a fitment carrier being moved along a continuous track. The next step includes rendering the fitment in an adhesive state. The next step includes conveying the formed, filled and sealed carton along a conveyor system disposed in relation to a portion of the continuous track. The final step includes applying the fitment in the adhesive state to the carton as the carton is conveyed along the conveyor system.

The method may also include centering the formed, filled and sealed carton by a plurality of projections on the fitment carrier before applying the fitment. The rendering step of the method may include dispensing hot melt to the back of the fitment. The rendering step of the method may alternatively include heating the back of the fitment to a temperature greater than the melting temperature of the fitment. The fitment applying step of the method may include engaging the back of the fitment to a pre-scored area of the formed, filled and sealed carton while the fitment is within the fitment holder, and displacing the fitment from the fitment holder by actuation of the fitment displacement mechanism. The method may also include orienting the fitment prior to placement of the fitment on the fitment carrier.

Yet another aspect of the present invention is a post processing fitment applicator that includes means for transporting cartons, a plurality of fitment carriers, means for moving each of the fitment carriers, a chute and means for rendering the back of the fitment in an adhesive state. Each fitment carrier places a fitment on a formed, filled and sealed carton. The moving means moves each of the plurality of fitment carriers at a movement equal to that of the transporting means for the series of formed, filled and sealed cartons. The chute delivers fitments from a supply of fitments to each of the plurality of fitment carriers at a receiving point. The rendering means renders the back of the fitment in an adhesive state.

Each of the plurality of fitment carriers of this embodiment of the applicator may include a fitment holder for holding a fitment and a fitment displacement mechanism for placing the fitment on a formed, filled and sealed carton. The supply of fitments of this embodiment of the applicator may include a hopper connected to the chute, a holding bin, and an elevator disposed to transport fitments from the bin to the hopper. The rendering means of this embodiment of the applicator may include means for heating the back of the fitment with hot air to a melting temperature of the fitment. The applicator of this embodiment may include a housing. The applicator of this embodiment may also include means for moving each of the cartons toward and away from the cartons being transported by the transport means. The rendering means of the applicator of this embodiment may include means for inducing a current in the back of the fitment to heat the back of the fitment to a melting temperature of the fitment.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

There is illustrated in FIG. 1 a schematic perspective view of the post processing fitment applicator of the present invention.

There is illustrated in FIG. 2 a top perspective view of the post processing fitment applicator of the present invention.

Figure 3:
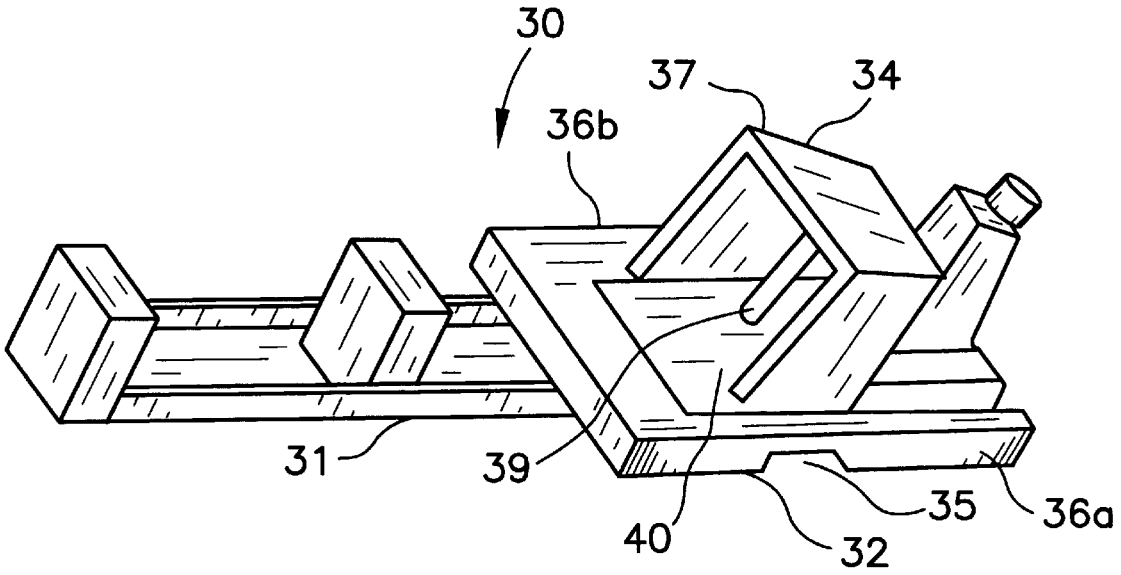

There is illustrated in FIG. 3 an isolated view of a fitment carrier of the plurality of carriers of the post processing fitment applicator of the present invention.

Figure 4:
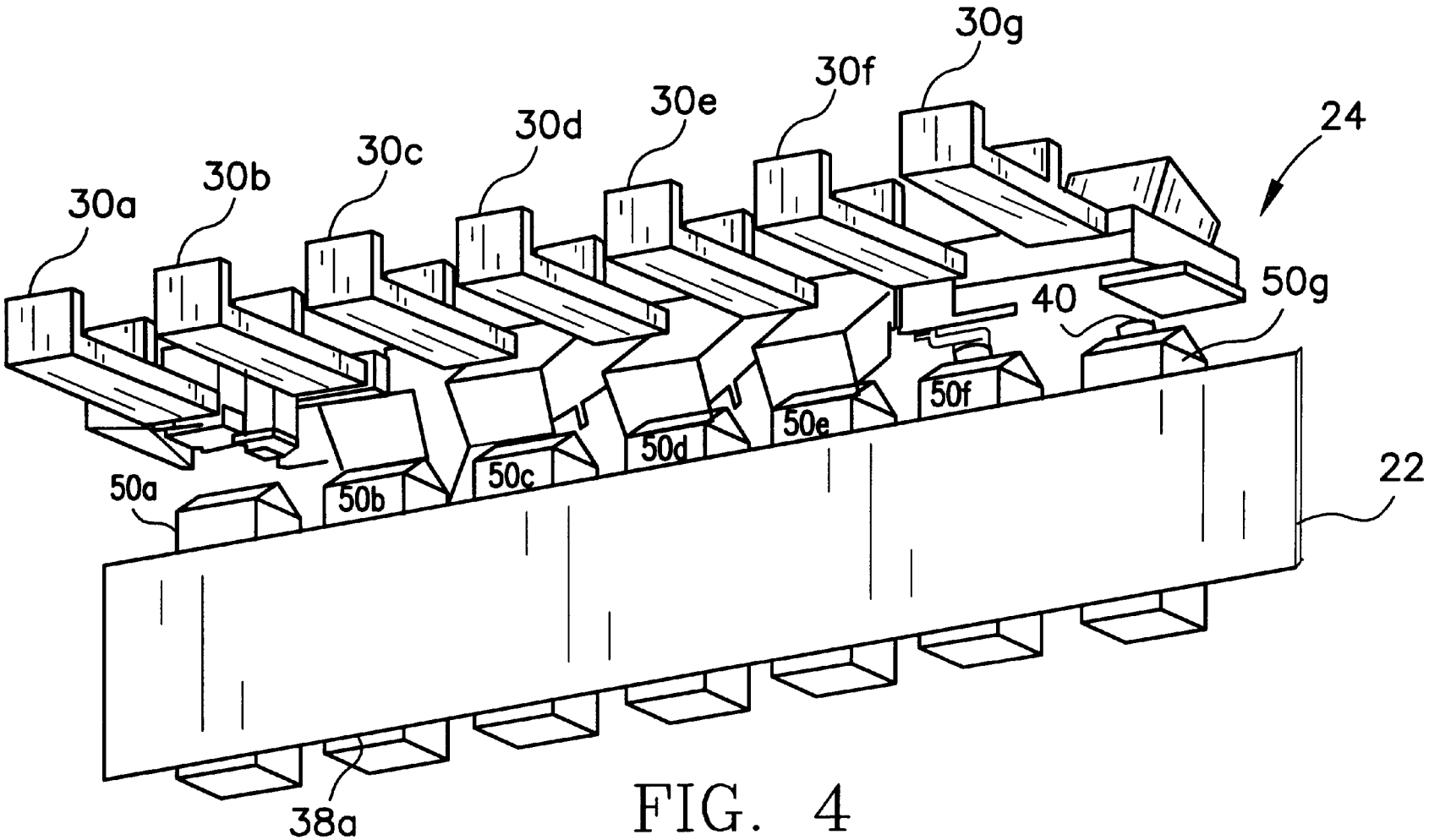

There is illustrated in FIG. 4 an isolated view of the plurality of fitment carriers of the post processing fitment applicator of the present invention applying fitments to cartons.

Figure 5:
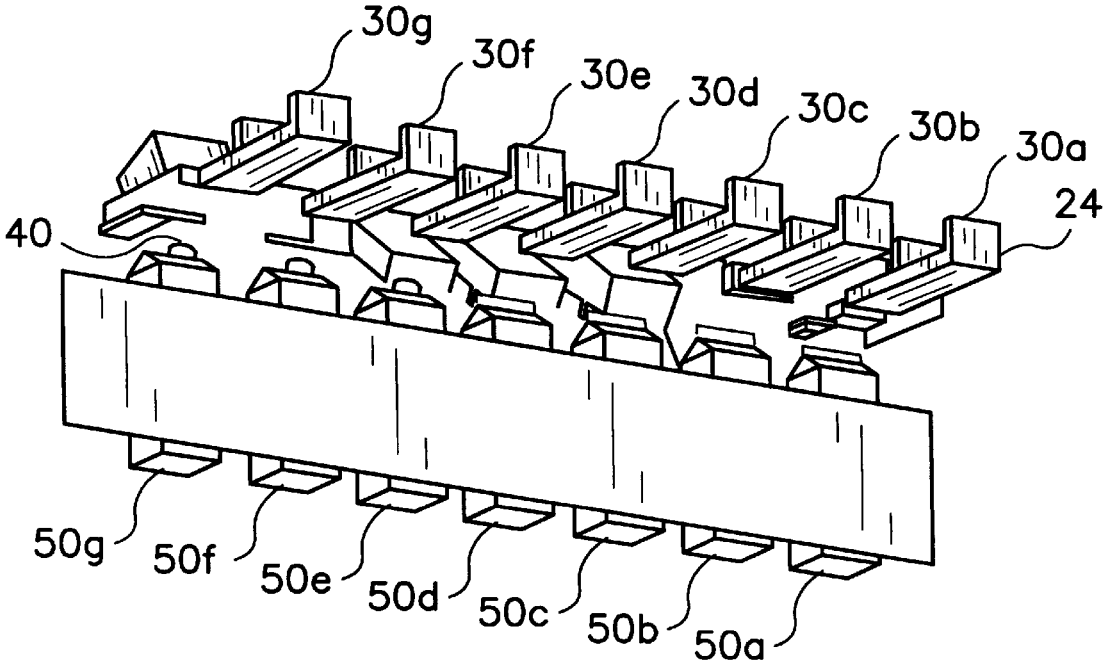

There is illustrated in FIG. 5 a reverse view of the plurality of fitment carriers of FIG. 4.

Figure 6:
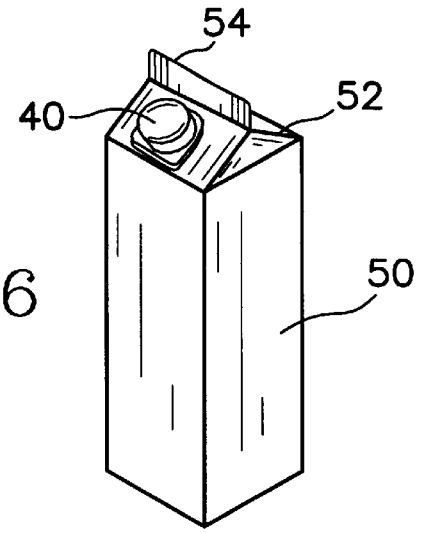

There is illustrated in FIG. 6 a top perspective view of a carton with a fitment thereon applied by the post processing fitment applicator of the present invention.

Figure 7:
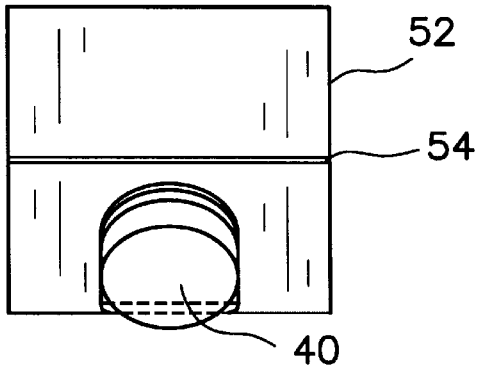

There is illustrated in FIG. 7 a top plan view of the carton of FIG. 6.

Figure 8:
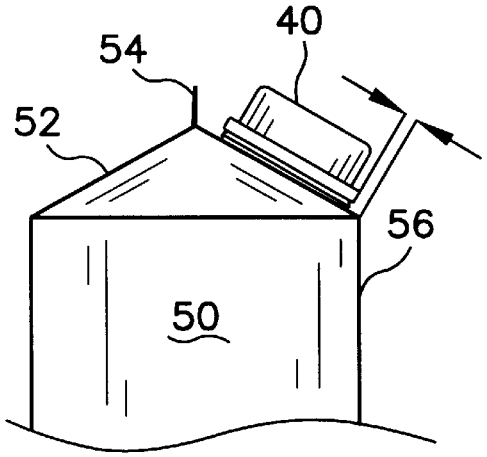

There is illustrated in FIG. 8 a side view of the carton of FIG. 6.

Figure 9:
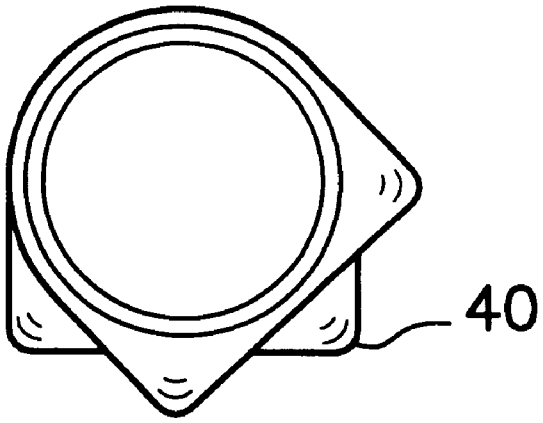

There is illustrated in FIG. 9 a plan view of one possible fitment utilized by the post processing fitment applicator of the present invention.

Figure 10:
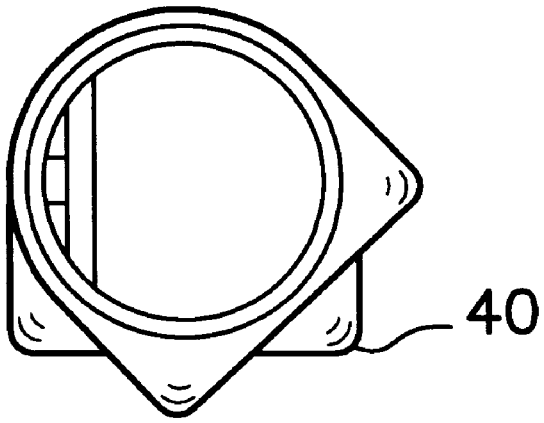

There is illustrated in FIG. 10 a modified view of the fitment of FIG. 9.

DETAILED DESCRIPTION OF THE INVENTION

Figure 1:
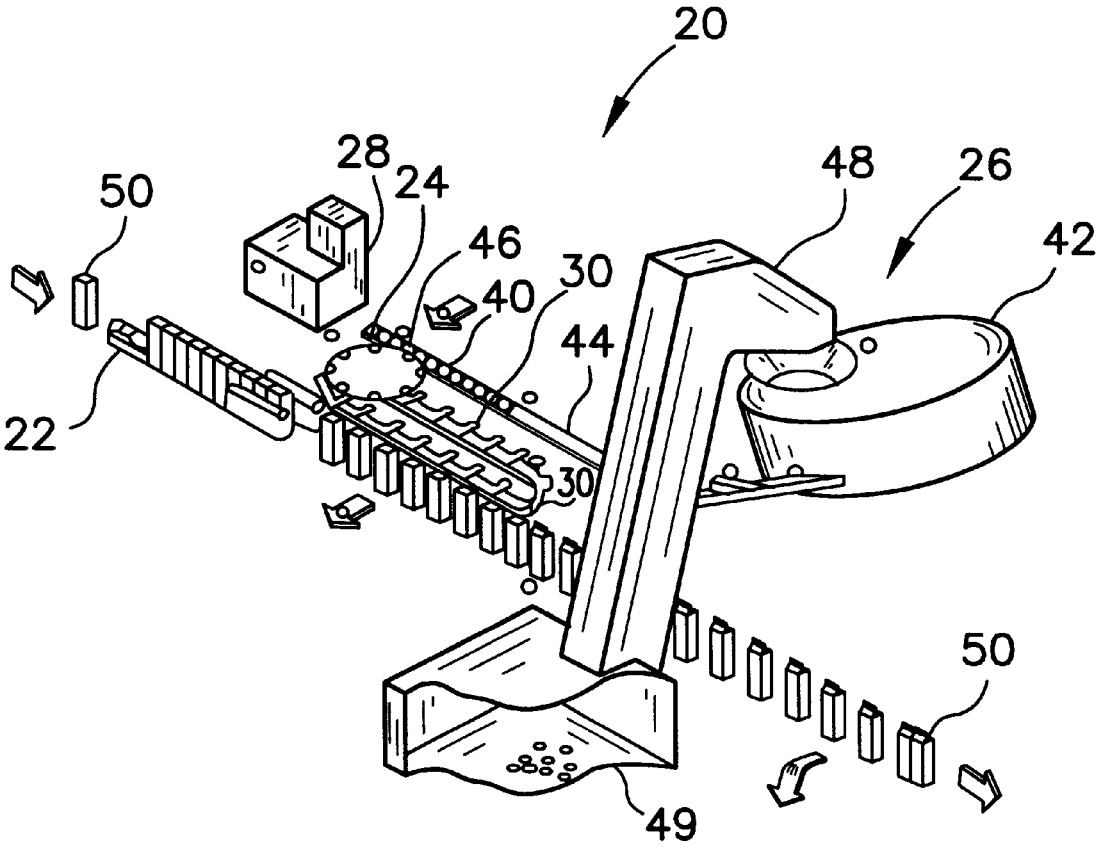
Figure 2:
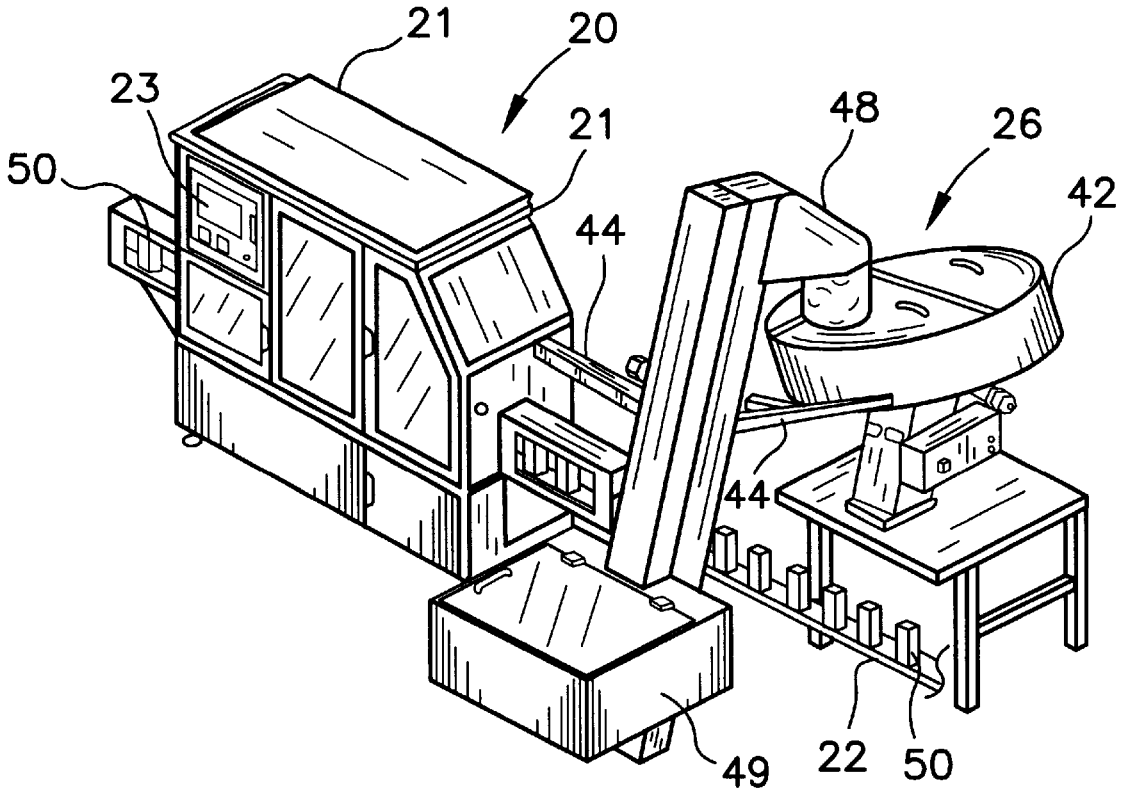

As shown in FIGS. 1 and 2, the post processing fitment applicator of the present invention is generally designated 20. The post processing fitment applicator 20 may be directly downline from a linear form, fill and seal packaging machine, not shown, such as a TETRA REX® packaging machine available from Tetra Pak, Incorporated of Chicago, Ill. In such an arrangement, as soon as the finished cartons exit the packaging machine, the cartons are conveyed to the post processing fitment applicator 20. Alternatively, the post processing fitment applicator 20 may be placed in a different section of a dairy or like facility in order to isolate the packaging machine or the post processing fitment applicator 20. Yet, it is not inconceivable to locate the post processing fitment applicator 20 at a completely different site from the packaging machine, such as the final distribution site of the finished product.

The post processing fitment applicator 20 generally includes a housing 21, a conveyor system 22, a continuous track 24, a supply of fitments 26, a hot melt dispenser 28 and a plurality of fitment carriers 30. The housing 21 encompasses the components of the post processing fitment applicator 20 that are involved in the fitment application operation in order to provide an enclosed controlled environment for the application of fitments 40 to cartons 50 conveyed along the conveyor system 22. The housing 21 not only provides for climate control, it also lessens the amount of contaminants that could interfere with the application operation on the post processing fitment applicator 20. The housing 21 also creates a safer operating environment for an user of the post processing fitment applicator 20. On the housing 21 may be a control panel 23 for allowing an user of the post processing fitment applicator 20 to input the necessary parameters such as the conveyance speed, the hot melt temperature, the orientation of the fitment 40, and the like. The operation of the post processing fitment applicator 20 may be controlled by a programmable logic circuit ("PLC") that generates the necessary commands and provides safety warnings in order for the post processing fitment applicator 20 to operate in an efficient and safe manner.

The supply of fitments 26 is generally composed of a hopper for the fitments 42, a delivery chute 44 which transports the fitments 40 from the hopper 42 to a receiving point 46, and an elevator 48 connected a holding bin 49 and positioned to transport fitments 40 from the bin 49 to the hopper 42. In operation, the fitments 40 are loaded into the bin 49 for transport to the hopper 42. The hopper 42 places one fitment 40 at a time onto the chute 44 where upon the fitments 40 are transported to the receiving point for placement on a fitment carrier 30. The chute 44 may have various orienting components to properly orient each fitment 40 before placement on a fitment carrier 30.

The plurality of fitment carriers 30 are connected to the continuous track 24 for movement thereabout in predetermined intervals. The continuous track 24 with the plurality of carriers 30 thereon, is disposed to have a portion above part of the conveyor system 22 for application of fitments 40 to moving cartons 50 that are conveyed along the conveyor system 22. Each of the fitment carriers 30 retrieves a fitment 40 from the receiving point 46 where upon the fitment carrier 30 with the fitment 40 thereon is transported on the continuous track 24 to the hot melt dispenser 28. The hot melt dispenser 28 applies on predetermined quantity of hot melt to the back of each of the fitments 40. Preferably, the hot melt may be applied to only a flange portion of the fitment 40. The hot melt provides the adhesive necessary for the fitment 40 to be attached to the carton 50. The hot melt may include a tank, a hose and a dispenser gun (all of which are not shown). The operating temperature may vary from 180 degrees Celsius to 200 degrees Celsius. Alternatively, the hot melt dispenser 28 may be replaced with another means for adhesion of a fitment 40 to a carton 50. One possibility would be to substitute a fitment heater for the hot melt dispenser 28. Such an alternative would heat the back of the fitment 40 through forced hot air or current induced heating in order to impart sufficient heat to the fitment 40 to commence melting of the thermoplastic fitment 40.

From the hot melt dispenser 28, each of the fitment carriers 30 is maneuvered for temporary engagement with a carton 50 in order to apply the fitment 40 to the carton 50 as the carton 50 is conveyed along the conveyor system 22.

A fitment carrier 30 is illustrated in FIG. 3. Each of the fitment carriers 30 are generally composed of a body 31, a fitment holder 32, a fitment displacement mechanism 34, a pair of arms 36*a* and 36*b*, and projections 38*a–d*, not shown in FIG. 3. The fitment holder 32 accepts a fitment 40 at the receiving point 46 through aperture 35. The fitment holder 32 also holds the fitment on the carton 50 during the initial contact. The fitment displacement mechanism 34 pushes the fitment 40 from the fitment holder 32 onto the carton 50. The fitment displacement mechanism 34 may be a U-shaped frame 37 with a prong 39 thereon. The projections 38*a–d* act to center the carton 50 for proper positioning of the fitment 40 thereon.

As shown in FIGS. 4 and 5, each of the plurality of fitment carriers 30 performs a seven step application operation for application of a fitment 40 to a carton 50. The term seven step may be a misnomer since the application operation is continuous while each of the cartons 50 is conveyed along the conveyor system 22 at a predetermined rate to match the movement of the fitment carriers 30. Using the seven cartons 50*a–g* and the seven fitment carriers 30*a–g* shown in FIGS. 3 and 4 to demonstrate the seven step application operation, the operation begins with a fitment carrier 30*a* aligning itself with a carton 50*a*. The proper alignment is very important to ensure that the fitment is placed over the pre-scored area of the carton 50. The pre-scored area is a partially incised area which defines the aperture for access to the product contained within the carton 50. This weakened area allows for a fitment with a plunger, cutting edge or some other means for rupturing the pre-scored area to create the aperture in the carton 50 upon the initial access by the consumer. The area of the carton 50 may also be an aperture with a membrane.

The fitment carrier 30*b* and carton 50*b* demonstrate the next step where the fitment carrier 30*b* begins its descent toward to gable top of the carton 50*b*. The fitment 40 on the carrier 30*b* has yet to contact the carton 50*b*. At the next step illustrated by the fitment carrier 30*c* and the carton 50*c*, the fitment carrier 30*c* centers the carton 50*c* for placement of the fitment 40 thereon. During this step, the fitment displacement mechanism 34 contacts the fitment 40 being held in the fitment holder 32 for displacement thereof.

At the next step, illustrated by the fitment carrier 30*d* and the carton 50*d*, the fitment 40 contacts the carton 50*d*. As the fitment 40 contacts the carton 50*d*, the hot melt begins to adhere to the carton 50*d* in order to create a tight bond between the fitment 40 and the carton 50*d*. The fitment displacement mechanism 34 applies a force on the fitment 40 to ensure a tight bond between the fitment 40 and the carton 50*d*. The fitment 40 is still within the fitment holder 32 during this step.

At the next step, illustrated by the fitment carrier 30*e* and the carton 50*e*, the fitment holder 32 retracts while the fitment displacement mechanism 34 holds the fitment 40 on the carton 50*e*. The fitment 40 should be held for a set amount of time to allow for adhesion to occur between the fitment 40 and the carton 50*e*. At the next step, illustrated by the fitment carrier 30*f* and the carton 50*f*, the fitment displacement mechanism 34 retracts allowing the fitment 40 to adhere to the carton 50*f*. The final step, illustrated by the fitment carrier 30*g* and the carton 50*g*, has the fitment carrier 30*g* returning to its commencement state.

The movement of the fitment carriers 30 in relation to the cartons 50 may be actuated by a camming mechanism or servomotors. The movement of the continuous track 24 with the plurality of carriers 30 thereon may be accomplished by rotating drums driven by a servomotor or central shaft.

As shown in FIGS. 6–8, a carton has a gable top 52 with a top fin 54 and a fitment 40 thereon. The fitment 40 should be applied a certain distance from the side panel 56 in order to ensure good pourability. The carton 50 may a pre-scored area, not shown, or have a pre-punched aperture covered with a membrane. The membrane should be composed of a material that may be easily ruptured by the fitment 40. As shown in FIGS. 9 and 10, the fitments 40 may have a tamper evidence means.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A post processing fitment applicator for applying fitments to each of a series of formed, filled and sealed cartons, the applicator comprising:

a conveyor for transporting the series of formed, filled and sealed cartons, the conveyor having a straight-line portion extending along at least a portion thereof;

a continuous track partially positioned in proximity to the conveyor, the continuous track having a straight-line portion extending along at least a portion thereof, the continuous track straight-line portion and the conveyor straight-line portion having portions that are coextensive with one another;

a plurality of fitment carriers moveable about the continuous track for placing a fitment to a formed, filled and sealed carton, each fitment carrier including a fitment holder for receiving a fitment and holding the fitment on the formed, filled and sealed carton upon initial engagement, a plurality of projections extending therefrom for positioning the carton relative to the fitment to properly position the fitment on the carton, and a fitment displacement element for applying a force on the fitment to secure the fitment on the formed, filled and sealed carton;

a chute for delivering fitments from a supply of fitments to each of the plurality of fitment carriers at a receiving point along the continuous track; and a hot melt dispenser disposed subsequent to the receiving point along the continuous track, the hot melt dispenser disposed to coat each of the fitments on each of the plurality of carriers with hot melt, wherein the coextensive portions of the conveyor straight-line portion and the continuous track straight-line portion move with one another so as to apply and secure the fitment to the formed, filled and sealed carton as it moves along the conveyor.

2. The post processing fitment applicator according to claim 1 wherein the supply of fitments comprises a hopper connected to the chute, a holding bin, and an elevator disposed to transport fitments from the bin to the hopper.

3. The post processing fitment applicator according to claim 1 wherein the conveyor system transports a set number of cartons at predetermined intervals for application of fitments to the cartons.

4. The post processing fitment applicator according to claim 1 further comprising an housing encompassing at least the continuous track and the hot melt dispenser.

5. The post processing fitment applicator according to claim 1 wherein each of the plurality of fitment carriers are moveable toward and away from the cartons being conveyed on the conveyor system.

6. The post processing fitment applicator according to claim 1 wherein each of the fitment displacement elements comprises a U-shaped frame with a projection thereon for engagement with a fitment.

7. A method for applying a fitment to a formed, filled and sealed carton, the method comprising:

placing a fitment in a fitment carrier being moved along a continuous track, the fitment carrier continuous track moving at least in part in a first straight-line path, the fitment carrier configured to carry the fitment and to convey the fitment in the first straight line path parallel to the continuous track and to move the fitment in a second direction generally transverse to the first straight line path to engage the fitment with the formed, filled and sealed carton;

rendering the fitment in an adhesive state;

conveying the formed, filled and sealed carton along a conveyor system having at least a portion thereof moving in a straight-line track, the straight-line portion being disposed generally parallel to and in spaced relation to the straight-line portion of the continuous track;

conveying the fitment in the first straight line path and moving the fitment in the second direction generally parallel to the first straight line path;

centering the fitment on the formed, filled and sealed carton by a plurality of projections on the fitment carrier before applying the fitment; and applying the fitment, by movement in the second direction, in the adhesive state to the carton as the carton is conveyed along the conveyor system, in the first straight line path.

8. The method according to claim 7 wherein rendering the fitment in an adhesive state comprises dispensing hot melt to the back of the fitment.

9. The method according to claim 7 wherein rendering the fitment in an adhesive state comprises heating the back of the fitment to a temperature greater than the melting temperature of the fitment.

10. The method according to claim 7 wherein applying the fitment to a carton comprises engaging the back of the fitment to a pre-scored area of the formed, filled and sealed carton while the fitment is within the fitment holder, and displacing the fitment from the fitment holder by actuation of a fitment displacement mechanism.

11. The method according to claim 7 further comprising orienting the fitment prior to placement on the fitment carrier.

12. A post processing fitment applicator for applying fitments to each of a series of formed, filled and sealed cartons, the applicator comprising:

means for transporting the series of formed, filled and sealed cartons;

a plurality of fitment carriers for placing a fitment on a formed, filled and sealed carton, each fitment carrier including a fitment holder for receiving a fitment and holding the fitment on the formed, filled and sealed carton upon initial engagement, a plurality of projections extending from each fitment holder for positioning the carton relative to the fitment to properly position the fitment on the carton, and a fitment displacement element for applying a force on the fitment to secure the fitment on the formed, filled and sealed carton;

means for moving each of the plurality of fitment carriers at a movement equal and parallel to that of the transporting means for the series of formed, filled and sealed cartons;

a chute for delivering fitments from a supply of fitments to each of the plurality of fitment carriers at a receiving location extending along a generally straight-line path;

means for rendering the back of the fitment in an adhesive state; and means for moving the fitment in a direction generally transverse to the movement of each of the plurality of fitment carriers.

13. The post processing fitment applicator according to claim 12 wherein the supply of fitments comprises a hopper connected to the chute, a holding bin, and an elevator disposed to transport fitments from the bin to the hopper.

14. The post processing fitment applicator according to claim 12 further comprising a housing.

15. The post processing fitment applicator according to claim 12 further comprising means for moving each of the cartons toward and away from the cartons being transported by the transport means.

16. The post processing fitment applicator according to claim 12 wherein the rendering means comprises means for inducing a current in the back of the fitment to heat the back of the fitment to a melting temperature of the fitment.

* * * * *